US007583230B2

(12) United States Patent
Vincent

(10) Patent No.: US 7,583,230 B2
(45) Date of Patent: Sep. 1, 2009

(54) SYSTEM AND METHOD FOR TUNING A MONOPOLE ANTENNA

(75) Inventor: Robert J. Vincent, Warwick, RI (US)

(73) Assignee: Board of Governors for Higher Education, State of Rhode Island and Providence Plantations, Providence, RI (US)

( * ) Notice: Subject to any disclaimer, the term of this patent is extended or adjusted under 35 U.S.C. 154(b) by 0 days.

(21) Appl. No.: 12/029,741

(22) Filed: Feb. 12, 2008

(65) Prior Publication Data

US 2008/0180334 A1 Jul. 31, 2008

Related U.S. Application Data

(63) Continuation of application No. PCT/US2006/036307, filed on Sep. 18, 2006.

(60) Provisional application No. 60/719,378, filed on Sep. 22, 2005.

(51) Int. Cl.

| | |
|---|---|
| ***H01Q 1/00*** | (2006.01) |
| ***H01Q 9/00*** | (2006.01) |
| ***H01Q 3/00*** | (2006.01) |

(52) U.S. Cl. ..... 343/722; 343/749; 343/766

(58) Field of Classification Search ..... 343/722, 343/749, 766, 752, 900

See application file for complete search history.

(56) References Cited

U.S. PATENT DOCUMENTS

| | | | | |
|---|---|---|---|---|
| 2,474,242 | A | 6/1949 | Gieringer | |
| 3,268,903 | A | 8/1966 | Kuecken et al. | |
| 3,445,849 | A | 5/1969 | Sanford | |
| 4,259,672 | A | 3/1981 | Newcomb | |
| 5,221,930 | A | 6/1993 | Scott | |
| 5,865,390 | A * | 2/1999 | Iveges | 242/375 |
| 6,677,914 | B2 | 1/2004 | Mertel | |
| 6,697,610 | B1 * | 2/2004 | Tait | 455/277.1 |
| 6,791,504 | B1 | 9/2004 | Miller | |
| 2004/0066335 | A1 | 4/2004 | Ashjaee | |
| 2006/0022883 | A1 * | 2/2006 | Vincent | 343/722 |

FOREIGN PATENT DOCUMENTS

| | | | |
|---|---|---|---|
| WO | 2005001989 | A2 | 1/2005 |
| WO | WO 2005001989 | A2 | 1/2005 |

* cited by examiner

*Primary Examiner*—Shih-Chao Chen
(74) *Attorney, Agent, or Firm*—Gauthier & Connors LLP

(57) ABSTRACT

An antenna system is disclosed that includes a base section to which a signal connector may be attached, and a radiating section distal from said base section. The radiating section includes a flexible electrically conductive material and an adjustment system for changing a length of the electrically conductive material responsive to a control signal.

20 Claims, 5 Drawing Sheets

SYSTEM AND METHOD FOR TUNING A MONOPOLE ANTENNA

PRIORITY

This application is a continuation of International Patent Application No. PCT/US2006/036307, filed on Sep. 18, 2006 and claims priority to U.S. Provisional Patent Application 60/719,378, filed on Sep. 22, 2005, all of which are incorporated herein by reference in their entirety.

BACKGROUND

The present invention generally relates to antennas, and relates in particular to antenna systems that include one or more monopole antennas.

Monopole antennas typically include a single pole that may include additional elements with the pole. Non-monopole antennas generally include antenna structures that form two or three dimensional shapes such as diamonds, squares, circles etc.

As wireless communication systems (such as wireless telephones and wireless networks) become more ubiquitous, the need for smaller and more efficient antennas such as monopole antennas (both large and small) increases. Many monopole antennas operate at very low efficiency yet provide satisfactory results. In order to meet the demand for smaller and more efficient antennas, the efficiency of such antennas must improve.

Further, the adjustment or tuning of the operating frequency of an antenna is sometimes required. Such tuning, however, is typically available only over a small range. Adjustment of an antenna over a wide operating frequency range of, for example, 1.5 to 2:1 or more generally requires a number of antennas or requires base-loading (sometimes called base-tuning). Base-loading involves matching the antenna load presented to the transmitter by varying the load. The efficiency of such systems, however, is generally low and radiation performance of such antennas will vary widely over the full tuning range of the antenna. Efficiency or antenna gain can vary widely from one end of this tuning range to the other. For example, antennas of this type may have efficiency or gain from a high of 60% to a low of less than 10%. The lower gain is usually associated with the lowest frequency. An antenna with an efficiency or gain of 10% will radiate 1 watt out of every 10 the transmitter loads into the tuner. This generally results in very robust tuner designs when high power is utilized. A 5 Kw transmitter at an impedance of 50 ohms will be capable of supplying 10 amps of average RF current operating in the continuous mode. This may range to peaks as high as 15 amps or more when amplitude modulation is used. If these 10 to 15 amps of RF current are transformed from 50 ohms to an impedance that is much higher, then the tuner must be designed to withstand extremely either high voltages or high currents. Either way, it becomes a significant problem at higher power levels to control the antenna matching and maintain efficiency.

As mentioned above, a number of antennas may be used instead of the base-loading technique to achieve wide bandwidth operation. Such a multi-antenna system may include an antenna for each desired frequency. Each antenna may be designed to present a constant 50 ohm load at the operating frequency confined within some bandwidth. Another alternative involves lengthening and shortening a common antenna by inserting and removing sections of tubing as needed or using a telescoping mast antenna. Telescoping mast antennas present problems in achieving the lowest and highest frequency of operation as the necessary steps for adjusting the antenna are time consuming and labor intensive. For example, for a ¼ wave monopole antenna this typically requires that the antenna be taken apart and re-assembled using longer sections.

There is a need, therefore, for more efficient and cost effective implementation of a monopole antenna, as well as other types of antennas and antenna systems, and there is a further need for an efficient and cost effective method for tuning such antenna systems. For example, there is a need for a method of rapidly changing the antenna resonance to any desired frequency within its range and while maintaining a constant bandwidth provide a constant 50 ohm match to the transmission line connected to the transmitter or final amplifier. The mechanism for accomplishing this must have the capability of handling the large radio frequency current and transforming this into radiation by the antenna. It is desirable, for example, to provide an antenna designed for typical operation within the AM broadcast band of 535-1700 kHz, and to have a 30 kHz bandwidth (+/−15 kHz).

SUMMARY

The invention provides an antenna system in accordance with an embodiment that includes a base section to which a signal connector may be attached, and a radiating section distal from said base section, said radiating section including a flexible electrically conductive material and adjustment means for changing a length of said electrically conductive material responsive to a control signal. In accordance with certain embodiments, the adjustment means includes a stepper motor for causing the electrically conductive material (e.g., a metal tape) to be wound onto or un-wound from a take-up roller.

BRIEF DESCRIPTION OF THE DRAWINGS

The following description may be further understood with reference to the accompanying drawings in which.

The drawings are shown for illustrative purposes only.

DETAILED DESCRIPTION OF THE ILLUSTRATED EMBODIMENTS

A distributed loaded monopole antenna may include a radiation resistance unit for providing significant radiation resistance, and a current enhancing unit for enhancing the current through the radiation enhancing unit as disclosed, for example in U.S. Published Patent Application Publication No. 20060022883, the disclosure of which is hereby incorporated by reference. The radiation resistance unit may include a coil in the shape of a helix, and the current enhancing unit may include load coil and/or a top unit formed as a coil or hub and spoke arrangement. The radiation resistance unit is positioned between the current enhancing unit and a base (e.g., ground), and may, for example, be separated from the current enhancing unit by a distance of $2.5316\times10^{-2}\lambda$ of the operating frequency of the antenna to provide a desired current distribution over the length of the antenna.

Figure 1:
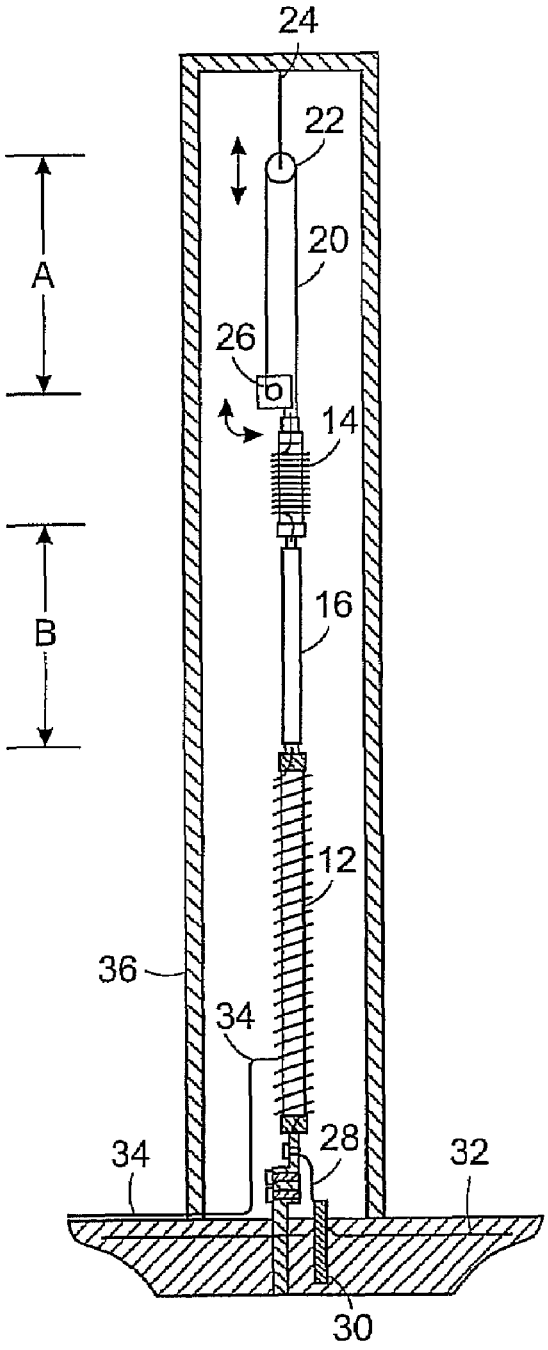
FIG. 1 shows an illustrative diagrammatic view of an antenna system in accordance with an embodiment of the invention.

As shown in FIG. 1, a diagrammatic view of an antenna system 10 of the invention includes a radiation resistance unit 12 and a current enhancing unit 14. The radiation resistance unit 12 may be formed in a variety of shapes, including but not limited to round, rectangular, flat and triangular. The radiation resistance unit 12 may be wound with wire, copper braid or copper strap or other conductive material around the form and is such that it's length is very much longer than it's width or diameter. The helix 12 is formed as a conductive coil that is wrapped around a non-conductive cylinder wherein the coil windings are mutually spaced from one another by a distance of approximately the thickness of the coil.

The current enhancing unit 14 (such as, for example, a load coil) may also be formed of a variety of conductive materials and may be formed in a variety of shapes. The unit 14 is positioned above the unit 12 and is separated a distance above the unit 12 and supported by a conductive mid-section 16 (e.g., aluminum tubing). The current enhancing unit 14 when placed a distance above the radiation resistance unit 12 performs several important functions. These functions include raising the radiation resistance of the helix and the overall antenna.

The antenna system 10 also includes a conductive top section 20 comprising a flexible strip of a conductive metal that is held in tension by a pulley 22 coupled to a non-conductive retractable chord 24. As a motor 26 winds the conductive metal around a take-up roll, the distance (A) of the conductive material 20 is reduced, and unwinding the conductive metal increases the distance (A) of the conductive material 20.

The antenna provides continuous electrical continuity from the base of the helix to the top of the antenna conductive metal 20. The base of the antenna is grounded by a ground wire 28 coupled to a ground post 30 and spoke-like ground wires 32. The signal to be transmitted may be provided by a coaxial cable 34 at any point along the radiation resistance unit 12 (e.g., near but not at the bottom of the unit 12). The signal may also be optionally passed through a capacitor in certain embodiments to tune out excessive inductive reactance in certain embodiments. The signal conductor of the coaxial cable 34 is coupled to one of the lower helix coil windings near the base as shown at 42, and the outer conductor of the coaxial cable is coupled to ground.

The choice of the distance B of the load coil above the helix impacts the average current distribution along the length of the antenna. The average current distribution over the length of the antenna varies as a function of the mid-section distance for a 7 MHz distributed loaded monopole antenna. The conductive mid-section has a length that provides that a sufficient average current is provided over the length of the antenna and provides for increasing radiation resistance.

The inductance of the load coil should be larger than the inductance of the helix. For example, the ratio of load coil inductance to helix inductance may be in the range of about 1.1 to about 2.0, and may preferably by about 1.4 to about 1.7. In addition to providing an improvement in radiation efficiency of a helix and the antenna as a whole, placing the load coil above the helix for any given location improves the bandwidth of the antenna as well as improving the radiation current profile. The helix and load coil combination are responsible for decreasing the size of the antenna while improving the efficiency and bandwidth of the overall antenna. In further embodiments, a top unit may be include a top section (e.g., one or more conductive spokes) that extends from the upper portion of the antenna above the conductive section 20 in a radial direction that is orthogonal to the vertical axis of the antenna itself. The use of such a top unit may further reduce the inductive loading of the helix and load coil to allow even wider bandwidth and greater efficiency. The top unit is included as part of the current enhancing unit. In further embodiments, the top unit may be used in place of the load coil as the current enhancing unit.

Figure 2:
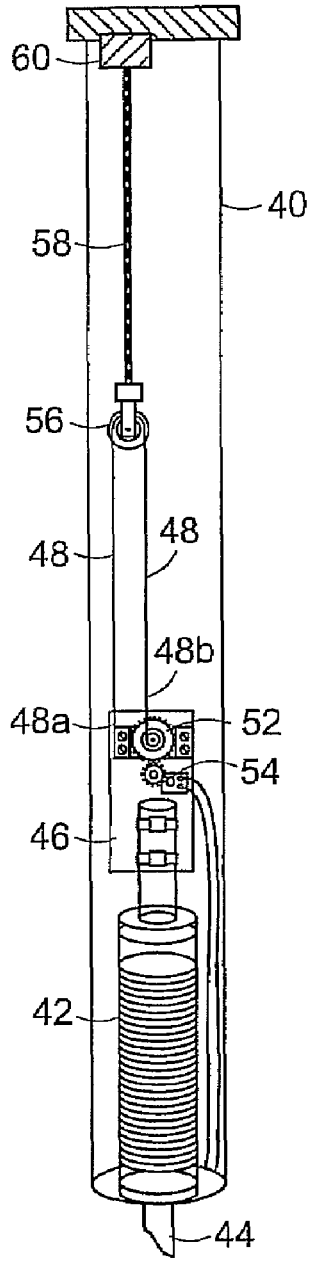
FIG. 2 shows an illustrative diagrammatic view of a portion of an antenna system in accordance with another embodiment of the invention.

The antenna system shown in FIG. 1 includes a rigid non-conductive housing 36 that is at least substantially transparent to the signals to be transmitted. In further embodiments, a plastic housing 40 may extend only from the mid-section to the top of the antenna. In particular and as shown in FIG. 2, an antenna may include a load coil 42 coupled to a mid-section 44, and the top of the load coil 42 may be coupled to a tuning unit base 46 that is secured to the upper end of the load coil 42. The tuning unit base 46 includes a flexible metal tape 48 having first end 48*a* that is fixed to the tuning unit base 46, and a second end 48*b* that is attached to a metal tape spool 52. The rotational position of the take-up roller is controlled by a servo-motor 54. The antenna system of FIG. 2 also includes an extension top unit that includes an insulated tape roller 56, and a stretchable cord that is held in varying amounts of tension by the tension chord 58 and pulley wheel 56. In accordance with further embodiments, and in particular, in antenna systems that are rather large, it may be necessary to provide a supplemental tension control system that includes a supplemental motor for controlling the length of a non-conductive cord to accommodate changes in the length of the antenna may not be easily accommodated by the tension cord. Such a supplemental tension control system may operate in a push/pull operation (rotating opposite one another) with the servo motor 54 permitting smooth variations in the length of the top conductive section. The supplemental tension control system may also be used to provide a coarse tension control, permitting a finer tension control to be provided by an extendable tension cord.

There is an electrical connection from the bottom of the helix up through the helix and through the midsection and continues through the load coil to the conductive top section. The helix at the bottom has provisions for tapping the turns of the helix. This allows connection from a source of radio frequency energy and proper matching by selecting the appropriate tap to facilitate maximum power transfer from the radio frequency source to the antenna. The placement of the load coil provides linear phase and amplitude responses through the bandwidth of the antenna and even beyond the normally usable bandwidth of the antenna. It has also been found that such an antenna has no harmonic response, and that its response is similar to that of a low Q band pass filter.

In accordance with different embodiments therefore, the invention provides a method of tuning a distributed load monopole (DLM) antenna over a very wide frequency range. In certain embodiments, distributed loaded monopole antennas of the invention have a very wide bandwidth of up to about 40% or more of the original frequency while maintaining a constant gain and presenting a constant 50 ohm load over a coaxial transmission line to the transmitter. Further embodiments provide for methods of rapidly tuning an antenna using digital control techniques as well as methods of calibrating an antenna for any frequency within range of the tuning system.

The top section of a DLM antenna, for example, provides an easily implemented method of tuning the antenna to resonance over any frequency within its available range. This available range may be determined by the load coil to helix inductance ratio and the length of the top section. The inductance and length of the helix as well as the length of the mid-section also have some impact on the length of the top section.

A 7 MHz DLM antenna, for example, was modified by adapting a rapid method to change the length of the top section as disclosed above. The top section was fitted such that it created a continuous conductive loop up the antenna above the load coil and returning to its origin in the form of a conductive metal tape. This accomplishes two things: 1) changing the length of the top section; and 2) permitting increasing or decreasing the amount of distributed capacity around the top section and top of the antenna. The 7 MHz antenna was able to be tuned from less than 6 MHz to greater than 8 MHz, a range of more than 25% of its original frequency. In addition, further tuning range could be achieved if the metal tape was folded such that more physical length was achieved within the same space. This has the effect, of adding or reducing distributed capacity. Over this frequency range, a constant 50 ohm impedance with resulting SWR of much less than 1.5 to 1 was achieved, and power radiated from the antenna varied less than ½ db over the full range of this tuning method.

Figure 3:
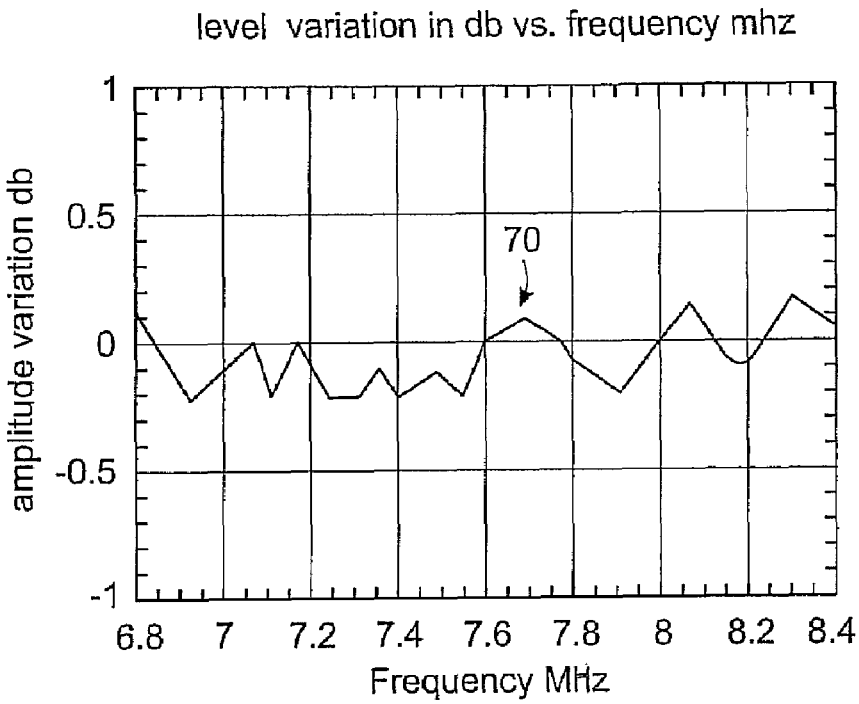
FIG. 3 shows an illustrative graphical representation of level variation in dB versus frequency for a system in accordance with an embodiment of the invention.
Figure 4:
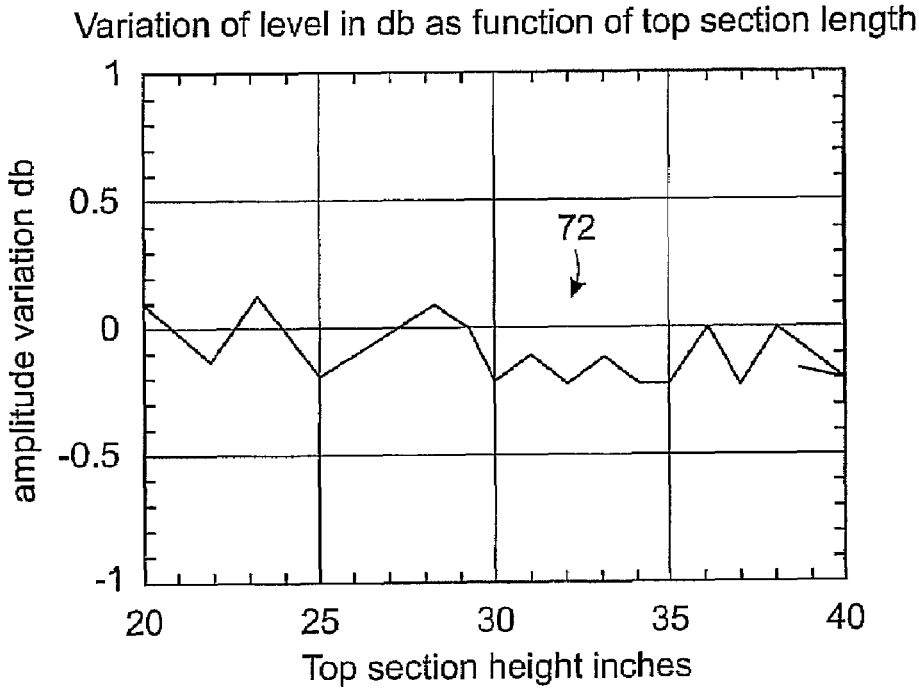
FIG. 4 shows an illustrative graphical representation of variations in level in dB as a function of top section length in a system in accordance with an embodiment of the invention.

FIG. 3 shows the variation in field level of measured antenna radiation over the full adjustment of the adjustable top section for the 7 MHz DLM antenna above. As shown at 70 in FIG. 3, as the frequency was varied from 6.8 MHz to 8.4 MHz, the amplitude variation in dB was less than approximately +/−0.2 dB. FIG. 4 shows the variation in radiated level as measured a distance from the antenna as the top section length was varied. As shown at 72 in FIG. 4, as the top section length was adjusted from 20 inches to 40 inches, the amplitude variation in dB was less than approximately +/−0.2 dB.

The antenna tuning methods of the invention may also be applied to dipole antennas made from DLM elements, or distributed loaded dipole, as well as any antenna that includes a top section that may be adjusted in length to tune the antenna to different frequency ranges.

Figure 5:
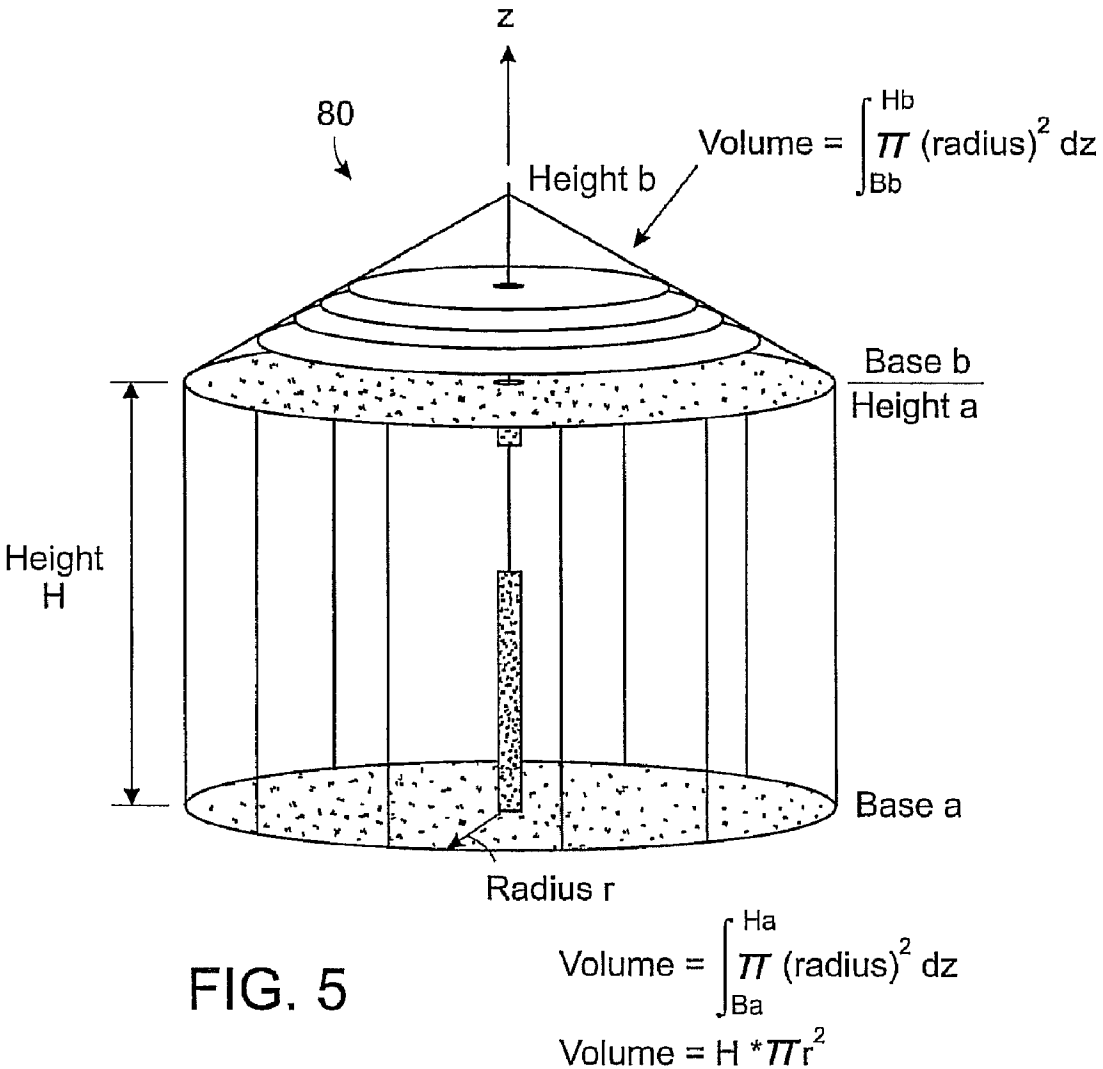
FIG. 5 shows an illustrative diagrammatic view of the relationship between antenna height and radiation in a system in accordance with an embodiment of the invention.

The tuning range required, for example, over an operating range from 1100 to 1700 kHz is approximately 42% or +/−21% from a band center. This range may be increased by switching in and out load coils of various inductance to effect a change in the varying distributed capacity. The described method of tuning works well without changing radiation efficiency of the DLM antenna because very little current is present in the top section. FIG. 5 shows at 80 a diagrammatic illustration of the changes in the volume of radiation that correspond to changes in the length of the top section. With the height up to the base of the top section denoted H, and the variable height of the top section denoted B, it is seen that the height B of the top section has a lesser effect on the volume of radiation than does the height H. This is because the volume of radiation is provided by the relationship $$\text{volume} = \int_0^{H+B} \pi r^2 \, dz$$

In the area of the top section B, the radius r is a decreasing function as the height B increases, which causes the height H to have a greater overall effect on the radiation volume.

The current profile along a distributed loaded monopole antenna is very uniform and large for a height that is just above the load coil. Changing the top section length has a small effect on the antenna current profile below the load coil. Varying the mid-section length has a very large effect on this current profile. The midsection length affects the current profile radius as well as the height of the current profile. This will have a large effect on the radiation ability of the antenna.

Figure 6:
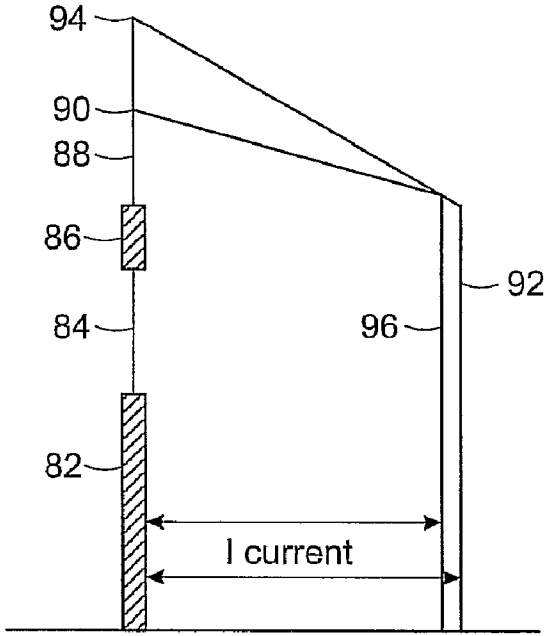
FIG. 6 shows an illustrative diagrammatic view of a current profile for a distributed loaded monopole antenna in accordance with an embodiment of the invention.

As shown in FIG. 6, a current profile of a distributed loaded monopole antenna in accordance with an embodiment of the invention may have a radiation resistance unit 82 (e.g., a helix), a conductive mid-section 84, and a current enhancing unit that includes a load coil 86 and a top section 88. If the top section has a height as indicated at 90, the current profile is as shown at 92, and if the top section is adjusted to have a height as indicated at 94, the current profile is as shown at 96.

Figure 7:
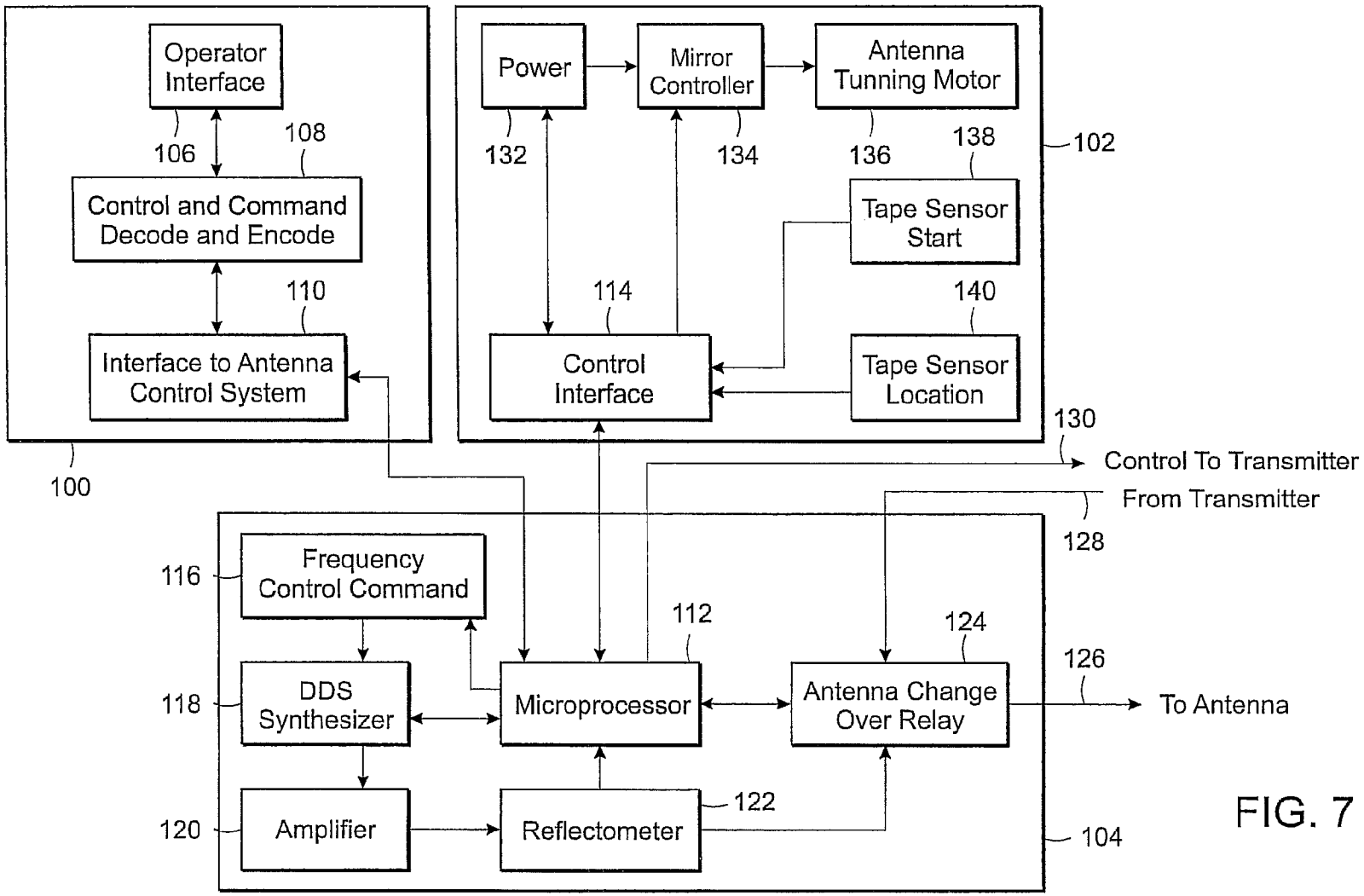
FIG. 7 shows an illustrative functional view of the operation of a system in accordance with an embodiment of the invention.

As shown in FIG. 7, a system of the invention an operator console portion 100, an antenna portion 102 and an antenna feed portion 104. The operator console portion 100 includes an operator interface 106 that communicates with a control and command decode and encode unit 108, which in turn communicates with an interface unit 110 to the antenna control system. The unit 110 communicates via bi-directional data control bus. The interface unit 110 to the antenna control system communicates with a microprocessor 112 of the antenna feed portion 104, and the microprocessor 112 communicates with a control interface unit 114 of the antenna portion 102. The microprocessor 112 also controls a frequency control command unit 116, which controls a direct digital synthesizer 118. The output of the DDS synthesizer 118 is provided to an amplifier 120, which is in communication with a reflectometer unit 122. The reflectometer unit 122 provides feedback to the microprocessor and communicates with an antenna change over relay unit 124. The antenna change over relay unit 124 drives the antenna 126, and receives information from the transmitter as indicated at 128 as well as control information from the microprocessor 112. The microprocessor 112 also provides control information to the transmitter as shown at 130.

The control interface unit 114 of the antenna portion 102 is in communication with a power unit 132 and a motor controller unit 134, which is driven by the power unit 132. The motor controller unit 134 drives the antenna tuning motor 136. Tape sensors 138 and 140 at the start position and at the current location respectively are also provided to the control interface 114. The tape sensors 138 and 140 provide feedback to the system regarding the length of the top conductive section of the antenna.

Figure 8:
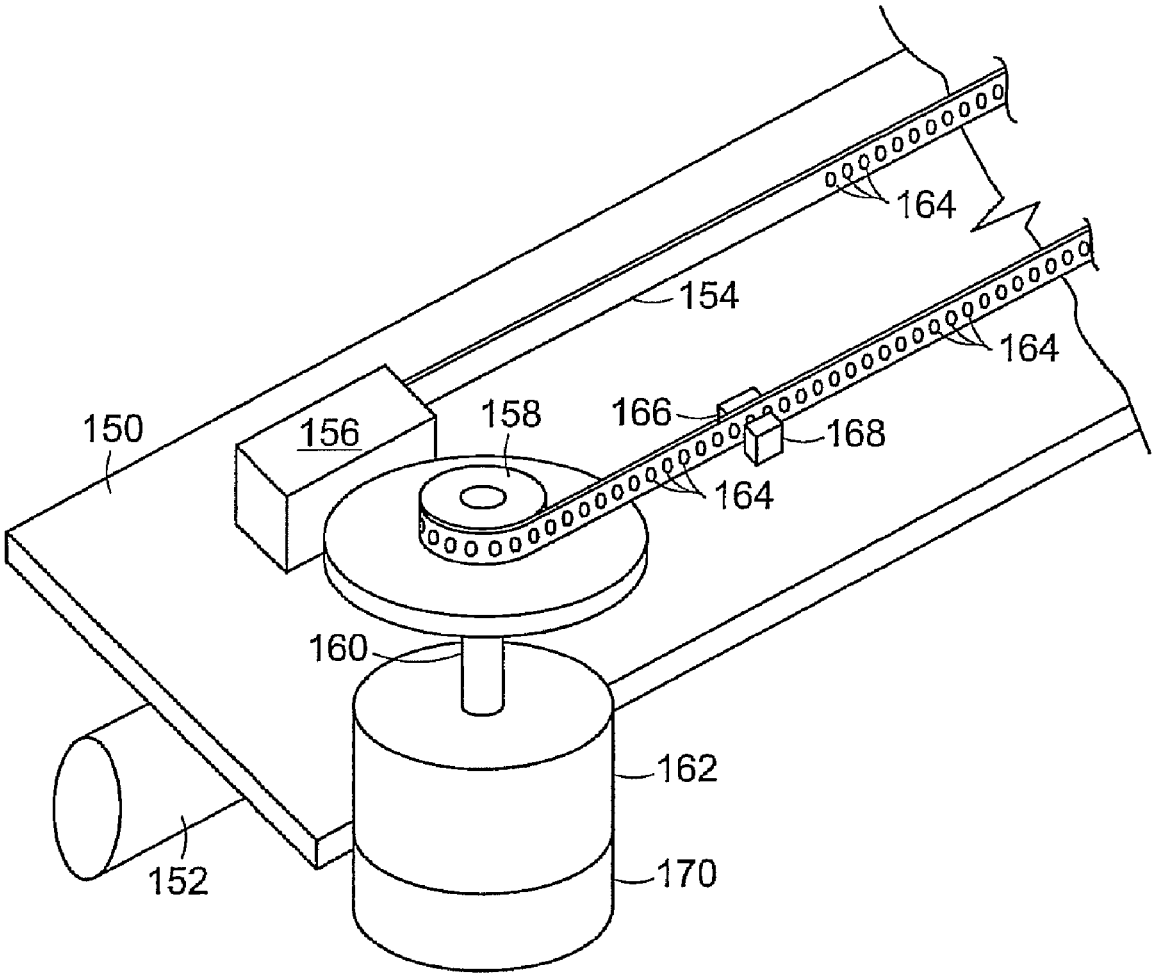
FIG. 8 shows an illustrative diagrammatic view of a system in accordance with a further embodiment of the invention.

FIG. 8 shows a tuning unit base 150 mounted on a conductive antenna structure 152. A conductive anchor 156 is mounted on the conductive base, and one end of a conductive tape 154 is fixed to the conductive anchor 156. The conductive base 150 also includes a tape windup spool 158 that is mounted to a drive shaft 160 of a drive motor 162. The tape may include indicator features 164 (such as either holes or reflective or opaque marks) that may be detected by a source 166 and detector 168 assembly (e.g., an LED and photodetector). The detection of the features as the tape 154 is wound onto or unwound from the spool 158 is employed to determine the length of the tape that extends from the anchor 156 (and therefore the length of the conductive top portion of the antenna). The tape 154 may also include an additional start feature and an additional end feature at the beginning and end of the string of features 164, which may be either detected by the source and detector assembly as the beginning and end, or may include a separate source and detector assembly for detecting the start and end features. In accordance with further embodiments, the motor 162 may be a stepper motor providing feedback and/or may include a position transducer 170 that provides rotor movement and position data to the control system.

The control of an antenna system may provide that an operator need only enter an operating frequency to initiate the antenna tuning process. This process will entail exciting the antenna at a greatly reduced power such as 100 milliwatts to calibrate the antenna tuning system. The calibration system will then rewind the metal tape 154 to its beginning indicated by optical source and detector assembly 166 and 168. This optical sensor will tell the microprocessor that the beginning of the tape has been reached. The motor 162 will stop, reverse direction, and begin to unwind the metal tape from the metal spool 158. At each hole 164 detected by the optical sensor the motor will stop, and the microprocessor will increment or decrement the excitation frequency of the direct digital synthesizer until a match condition is detected from the reflectometer until 122 by a minimum level. The microprocessor will note this frequency and hole number. The motor is reenergized until the next hole is encountered and the process is repeated. This is done for each of the holes. The process is performed with relatively high speed and over a relatively short period of time. When all the holes have been incremented the optical sensor will encounter the end feature indicating the end of the metal antenna tape. The microprocessor at this time will have compiled a look up table with frequency and hole number and most importantly will always know the hole number and the location on the tape. When the operator selects a desired operating frequency the microprocessor will determine how many holes it must increment or decrement the metal tape to reach this tuning point. When this is determined, the motor will be energized in slow mode and the frequency will be swept over a short frequency range that will amount to +/−1 hole. At this time the microprocessor will sample the output of the reflectometer and tell the motor to stop. This will be determined by minimum reflected power as indicated to the microprocessor by the reflectometer. When this condition is determined the microprocessor will tell the operator that tuning is complete for this frequency and the antenna may be switched over to the transmitter. The microprocessor will then de-energize all power to the antenna control functions and initiate full power to the antenna by the transmitter.

Because the motor to drive the tape rollers will have to be located on the antenna, and the possibility of electrical wires detuning the antenna exists, a battery system may be employed to provide motor power as well as power to the optical sensors and optical fiber interface to the microprocessor. In alternative embodiments, a pneumatic drive system may be used to power the motor. This may reduce battery demands, and smaller batteries can be utilized in certain embodiments.

The reflectometer unit (or a return loss bridge) may be used to sense when the antenna is in tune for a given frequency by coupling the output (which may normally used to drive a meter) may be used to drive an interface connected to the microprocessor. That interface may be an A/D converter. A dual port reflectometer may be used to examine both forward and reverse power simultaneously. This may be used to indicate a trend telling the microprocessor whether the antenna is being tuned in the correct direction. Since the antenna tuning control system may be located a distance from the antenna and the reflectometer a method of interfacing and controlling the antenna may be implemented.

Any antenna of reduced size requires some form of loading in order to resonate them at the operating frequency. This form of loading may be lumped of capacitance or inductance. Capacitance is typically employed at the highest point in the antenna, while inductance may be physically located anywhere within the antenna structure. The type of loading used and its position in the antenna structure determines the antenna efficiency and bandwidth. Base loading is applied in the form of inductance or a combination of inductance and capacitance, and is located at the lowest part of the antenna; which is typically the antenna feed point. Another form of loading is center loading where the loading is located in the center of the antenna structure. A difficulty, however, with center loading is that a large phase shift which occurs across the load coil may cause a large mount of apparent power to be dissipated by the load coil. This power may be as much as 80% of the applied power to the base of the antenna.

The distributed loaded monopole antenna of certain embodiments of the invention uses loading that is distributed through out the antenna structure consisting of a helix and a load coil as discussed above. The phase shift between the current and voltage along the antenna is small and sometimes there may be no phase shift changes along the major portion of the antenna. This means that no part of the inductive loading is not dissipating any apparent power or at least very little. Varying the top section also varies the amount and effect that the distributed capacity has on determining antenna resonance.

A distributed loaded monopole antenna achieves a very wide and useful bandwidth. This bandwidth may be three to five percent or more of the resonant operating frequency. The bandwidth may be moved within the antenna frequency range, which is the minimum to maximum frequency range of the antenna, by changing or varying the length of the top section. Antenna bandwidth may be moved anywhere within the antenna operating frequency range by adjustment of top section length.

Those skilled in the art will appreciate that numerous modifications and variations may be made to the above disclosed embodiments without departing from the spirit and scope of the invention.

What is claimed is:

1. An antenna system that includes a base section to which a signal is coupled, said base section also being coupled to around and including a radiation resistance unit, and a current enhancing section distal from said base section said radiation resistance unit and current enhancing unit facilitating raising the radiation resistance of the antenna, and said current enhancing section including a flexible electrically conductive material and adjustment means for changing a length of said electrically conductive material responsive to a control signal, said length being approximately one half of an exposed distance of said flexible electrically conductive material.

2. The antenna system as claimed in claim 1, wherein said adjustment means further includes a motor that drives a pick-up roller to which said flexible electrically conductive material is attached.

3. The antenna system as claimed in claim 1, wherein said antenna system is a distributed loaded monopole antenna.

4. The antenna system as claimed in claim 1, wherein said antenna system further includes a mid-section that is intermediate said base section and said current enhancing section.

5. The antenna system as claimed in claim 1, wherein said flexible electrically conductive material includes features that are detected by a position detection system.

6. The antenna system as claimed in claim 1, wherein said adjustment means includes a non-conductive tension cord that adjusts responsive to the length of the flexible electrically conductive material to provide an elongated current enhancing section.

7. The antenna system as claimed in claim 1, wherein said adjustment means includes a first motor for winding and unwinding said flexible electrically conductive material.

8. The antenna system as claimed in claim 1, wherein said adjustment means includes known position and optimal frequency data points stored in a microprocessor memory.

9. The antenna system as claimed in claim 1, wherein said system includes an automated controller for providing that the control signal for adjusting the length of the electrically conductive material is provided responsive to desired operating frequency information.

10. The antenna system as claimed in claim 1, wherein said system further includes a controller that is in communication with an operator console through which an operator may adjust the operating frequency of the antenna system.

11. An antenna system that includes a radiation resistance unit to which a signal is coupled, and a current enhancing unit for enhancing current through the radiation resistance unit, said current enhancing unit including a length of a flexible elongated electrically conductive material that extends away from said radiation resistance unit, around a mid-point and back toward said radiation resistance unit, and said system further including adjustment means for changing the length of said flexible elongated electrically conductive material to the mid-point responsive to a control signal, said adjustment means including bias means that biases the length of the flexible elongated conductive material in an extended position.

12. The antenna system as claimed in claim 11, wherein said flexible elongated electrically conductive material includes a flexible conductive material that is wrapped around a spool.

13. The antenna system as claimed in claim 12, wherein said adjustment means further includes a motor that drives a pick-up roller to which said flexible electrically conductive material is attached.

14. The antenna system as claimed in claim 12, wherein said flexible electrically conductive material includes features that are detected by a position detection system.

15. The antenna system as claimed in claim 13, wherein said adjustment means includes a non-conductive tension cord that adjusts responsive to the length of the flexible electrically conductive material to provide an elongated radiating section.

16. The antenna system as claimed in claim 12, wherein said adjustment means includes a first motor for winding and unwinding said flexible electrically conductive material.

17. The antenna system as claimed in claim 11, wherein said antenna system further includes an electrically conductive center portion that is intermediate said radiation resistance unit and said current enhancing unit.

18. The antenna system as claimed in claim 11, wherein said adjustment means includes known position and optimal frequency data points in a microprocessor.

19. The antenna system as claimed in claim 11, wherein said system includes an automated controller for providing that the control signal for adjusting the length of the flexible electrically conductive material is provided responsive to desired operating frequency information.

20. A method of changing the operating frequency of an antenna system, said method comprising the steps of:

receiving an input command regarding a desired operating frequency;

identifying a length of an elongated section of an antenna associated with the desired frequency, said elongated section being distal a base section that includes a radiation resistance unit to which a signal connector is coupled;

providing a control signal responsive to an identified length of the elongated section of the antenna associated with the desired frequency;

energizing a motor responsive to said control signal to cause the elongated section to be adjusted in length such that the antenna system is operated at the desired operating frequency, said step of adjusting the length of the elongated section involving passing the elongated section over a mid-point that is biased away from a base of the antenna.

* * * * *